US007071142B2

(12) United States Patent
Naruse et al.

(10) Patent No.: US 7,071,142 B2
(45) Date of Patent: Jul. 4, 2006

(54) THERMAL RECORDING MATERIAL

(75) Inventors: Mitsuru Naruse, Shizuoka-ken (JP); Mitsunobu Morita, Numazu (JP); Kunio Hayakawa, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/661,083

(22) Filed: Sep. 11, 2003

(65) Prior Publication Data

US 2004/0087444 A1 May 6, 2004

(30) Foreign Application Priority Data

Sep. 13, 2002 (JP) ..... 2002-268751

(51) Int. Cl.
*B41M 5/40* (2006.01)

(52) U.S. Cl. ..... 503/200; 503/226

(58) Field of Classification Search ..... 503/200, 503/226

See application file for complete search history.

(56) References Cited

U.S. PATENT DOCUMENTS

| | | | |
|---|---|---|---|
| 4,978,651 | A | 12/1990 | Furuya et al. |
| 4,985,345 | A | 1/1991 | Hayakawa et al. |
| 5,126,486 | A | 6/1992 | Furuya et al. |
| 5,306,687 | A | 4/1994 | Furuya et al. |
| 5,409,881 | A | 4/1995 | Mori et al. |
| 5,446,011 | A | 8/1995 | Hayakawa et al. |
| 5,447,900 | A | 9/1995 | Suzaki et al. |
| 5,489,501 | A | 2/1996 | Torii et al. |
| 5,827,590 | A | 10/1998 | Morita et al. |
| 5,919,729 | A | 7/1999 | Mori et al. |
| 5,972,836 | A | 10/1999 | Morita et al. |
| 6,060,427 | A | 5/2000 | Mori et al. |
| 6,180,560 | B1 | 1/2001 | Hayakawa et al. |
| 6,395,680 | B1 | 5/2002 | Morita et al. |
| 6,400,492 | B1 | 6/2002 | Morita et al. |
| 6,514,328 | B1 | 2/2003 | Katoh et al. |
| 2001/0005567 | A1 | 6/2001 | Harada et al. |
| 2003/0039917 | A1 | 2/2003 | Naruse et al. |
| 2003/0060366 | A1 | 3/2003 | Kaneko et al. |
| 2003/0125205 | A1 | 7/2003 | Kaneko et al. |
| 2003/0153460 | A1 | 8/2003 | Morita et al. |

FOREIGN PATENT DOCUMENTS

| | | |
|---|---|---|
| DE | 40 22 537 A | 1/1991 |
| EP | 1 211 094 A | 6/2002 |
| JP | 61-095978 | 5/1986 |
| JP | 61 095978 A | 9/1986 |
| JP | 11-302331 | 11/1999 |
| JP | 2001-132637 | 5/2001 |

OTHER PUBLICATIONS

U.S. Appl. No. 09/694,000, filed Oct. 23, 2000, claims, abstract, drawings.
U.S. Appl. No. 10/154,587, filed May 23, 2002, claims, abstract, drawings.
U.S. Appl. No. 07/263,240, filed Oct. 27, 1988, claims, abstract.

*Primary Examiner*—B. Hamilton Hess
(74) *Attorney, Agent, or Firm*—Cooper & Dunham LLP

(57) ABSTRACT

A thermal recording material including a substrate; a thermal coloring layer which is located overlying the substrate and which includes a leuco dye and a developer for coloring the leuco dye upon application of heat; and a protective layer which is located overlying the thermal coloring layer and which includes a binder resin, a crosslinking agent and a filler, wherein the binder resin in the protective layer includes a polyvinyl alcohol having a silanol group, and the crosslinking agent includes a zirconium compound of lactic acid.

10 Claims, No Drawings

THERMAL RECORDING MATERIAL

BACKGROUND OF THE INVENTION

1. Field of the Invention

The present invention relates to a thermal recording material, and more particularly to a thermal recording material having an excellent resistance to alcoholic flexographic ink.

2. Discussion of the Related Art

With diversification of information and expansion of needs, various types of recording materials have been researched and developed and are in practical use in the field of information recording. In particular, thermal recording materials are widely used in an information processing field (output of a desk-top calculator, computer or the like), a medical measurement recorder field, a low or high speed facsimile field, an automatic ticket machine field (railway tickets, admission tickets or the like), a thermal copying machine field and a label field for a point of sale (POS) system because of having advantages such that (1) images can be recorded only by applying heat; (2) the mechanism of recording apparatus is simple so that the apparatus can be miniaturized, and a recording material is easy to handle and inexpensive.

A need exists for a thermal recording material which quickly forms a color image having a high image density, wherein the image and the background have high durability. In recent years, thermal recording materials have been used in a large quantity in fields such as label printing, in which recorded images are required to have high reliability, and therefore there is a demand for a thermal recording material having a good preservation stability against plasticizers or oils and fats contained in an organic polymeric material used for a wrapping material.

In order to overcome the drawbacks, a protective layer has been conventionally located overlying a thermal recording layer. In particular, it is proposed that polyvinyl alcohol and modified polyvinyl alcohol are used as a resin in a protective layer, and a combination of these polyvinyl alcohols and a waterproof agent is used as a protective layer.

In addition, as a recent trend, the demand for the thermal recording material is shifting from POS labels for use in a food industry to labels for use in distribution and ticket industries. The thermal recording material is required to have good durability in a printing process and good qualities such as high speed printability (high heat sensitivity) rather than resistance to a plasticizer contained in a polyvinyl chloride wrapping film.

In order to meet the above quality requirements, not only investigation of dyes and developers and utilization of an intermediate layer, but also formation of a thin protective layer (about from 1 μm to 2 μm) are necessary. In particular, it is necessary for the thin protective layer to have excellent resistance to alcoholic flexographic ink.

In attempting to impart good waterproofing property to a protective layer, published unexamined Japanese Patent Applications Nos. S61-95978 and H11-302331 have disclosed that zirconium oxychloride, zirconium sulphate, zirconium nitrate, carbonic acid zirconium, stearic acid zirconium, octyl acid zirconium and silicic acid zirconium compounds are used in a protective layer. However, almost all the above-mentioned compounds cannot impart good resistance to water. In addition, compounds having resistance to water such as silanol modified PVA and carbonic acid zirconium ammonium are also proposed, but these compounds do not have good resistance to alcoholic flexographic ink. In addition, published unexamined Japanese Patent Application No. 2001-138637 discloses an organic titanium compound having good resistance to water, but the compound does not have good resistance to alcoholic flexographic ink. In addition, the thermal recording material causes a problem in that the background of images yellows under high humidity conditions.

SUMMARY OF THE INVENTION

Accordingly, an object of the present invention is to provide a thermal recording material which is free from the above-mentioned drawbacks, namely, which has a good resistance to alcoholic flexographic ink and good resistance to water without causing background yellowing even under high humidity conditions.

To achieve such an object, the present invention contemplates the provision of a thermal recording material including:

a substrate;

a thermal coloring layer which is located overlying the substrate and which includes a leuco dye and a developer for coloring the leuco dye upon application of heat; and a protective layer which is located overlying the thermal coloring layer and which includes a binder resin, a crosslinking agent and a filler, wherein the binder resin in the protective layer includes a polyvinyl alcohol having a silanol group, and the crosslinking agent includes a zirconium compound of lactic acid.

The polyvinyl alcohol is preferably an ethylene-modified polyvinyl alcohol having an ethylene unit and a silanol group.

The crosslinking agent is preferably included in an amount of from 0.01 to 0.50 parts by weight per 1 part by weight of the binder resin.

The thermal coloring layer further includes a polyvinyl alcohol having a silanol group.

The thermal coloring layer preferably includes an ethylene-modified polyvinyl alcohol having an ethylene unit and a silanol group.

It is preferable that the thermal recording material further includes a backcoat layer which is located overlying a side of the substrate opposite that bearing the thermal coloring layer and which includes a polyvinyl alcohol having a silanol group and a zirconium compound of lactic acid serving as a crosslinking agent.

In addition, the thermal recording material further includes an intermediate layer which is located between the substrate and the thermal coloring layer and which includes a hollow particle of a copolymer including monomer units of acrylonitrile, methacrylonitrile and a monomer having the following formula (I):

(I)

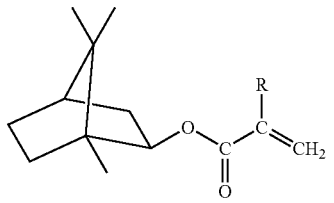

wherein R represents a hydrogen atom or a methyl group.

The thermal recording material further includes an adhesive agent layer located overlying a side of the substrate opposite that bearing the thermal recording layer.

The adhesive agent layer is preferably located overlying the surface of the backcoat layer.

The thermal recording material further includes an ink layer which is located overlying a surface of the protective layer and uses an ink including alcohol.

These and other objects, features and advantages of the present invention will become apparent upon consideration of the following description of the preferred embodiments of the present invention.

DESCRIPTION OF THE PREFERRED EMBODIMENTS

PVAs containing a silanol group for use in the present invention contain a silanol group having the following formulas in a structural unit. Specifically, the PVA has one or the other of the following structure units:

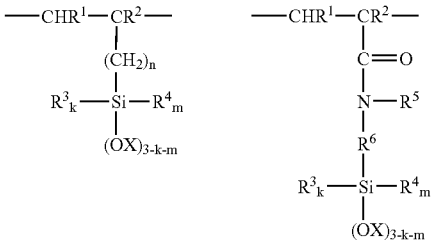

wherein $R^1$, $R^2$, $R^3$ and $R^5$ may be the same or different, and each individually represents a hydrogen atom or a carbon hydride having not greater than 8 carbon atoms; $R^4$represents an alkoxyl group having from 1 to 40 carbon atoms or an acyloxyl group; $R^6$represents an alkylene group having not greater than 5 carbon atoms or a divalent organic residue group in which the carbon chain is interrupted by an oxygen atom or a nitrogen atom; n represents an integer of from 0 to 4, k represents an integer of from 0 to 2, m represents an integer of from 0 to 3, wherein k+m is not greater than 2; and X represents a hydrogen atom.

The above-mentioned modified PVAs have been already commercialized.

The PVAs having a silanol group for use in the present invention preferably have a silanol group content of at least 0.01% by mole.

In addition, ethylene-modified PVAs having a silanol group are PVAs which have the above-mentioned silanol group and which have an ethylene unit. The content of the silanol group is from 1 to 20% by mole. In addition, the degree of polymerization of these PVAs is preferably from 300 to 3000 and more preferably from 500 to 2200. In addition, the degree of saponification thereof is preferably not less than 80%.

The crosslinking agent for use in the present invention is preferably a zirconium compound of lactic acid and more preferably zirconium lactate and ammonium salt thereof.

In the thermal recording material of the present invention, a heat insulating layer containing a hollow particle as a filler is preferably provided as an intermediate layer between the substrate and the thermal coloring layer. The hollow filler is preferably a resin filler. The hollow resin particle for use in the present invention includes a shell including acrylonitrile, methacrylonitrile and a monomer having the below-mentioned formula as essential main component monomer units (in particular, the particle distribution of the hollow particle can be sharpened by including the monomer unit having formula (I) therein) , in addition, other proper monomers capable of polymerizing can be optionally used as accessory component monomers.

(I)

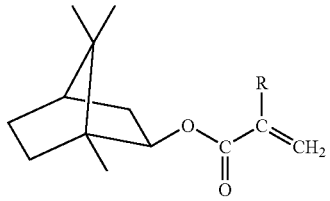

wherein R represents a hydrogen atom or a methyl group.

Specific examples of the monomers capable of polymerizing include methacrylic acid and salts thereof, dicyclopentenyl acrylate, acrylic esters, methacrylonitrile, ethylene, propylene, vinyl acetate, acrylamide, styrene, polyvinyl chloride, vinylidene chloride, methylmethacrylate and the like.

Furthermore, in order to form a crosslinking structure in a shell polymer, a monomer having not less than two polymeric double bonds is preferably included in an amount of from 0.01 to 3% by weight of all structural monomers.

Specific examples of the monomer having not less than two polymeric double bonds include general crosslinking monomers such as divinylbenzene, ethylene glycol di(meth) acrylate, trimethylolpropane, tri(meth)acrylate, pentaerythritol tri(meth)acrylate, triacrylic, formal, vinyl cinnamate, vinyl crotonate, vinyl maleate, di-cyclopentenyl acrylate, diethylene glycol diacrylate, triethylene glycol diacrylate, 1,3-butylene glycol dimethacrylate, 1,6-hexaglycol dimethacrylate, neopentyl glycol dimethacrylate, polypropylene glycol dimethacrylate, 2,2'-bis (4-methacryloxy diethoxyphenyl) propane, 2,2 '-bis(4-acryloxydiethoxyophenyl) propane, trimethylol propane triacrylate, tetramethylol metanetetra acrylate and diaryl phthalate.

Ethylene glycol di(meth)acrylate, trimethylolpropane tri (meth)acrylate, triacrylic formal are most preferably used.

Various preparation methods of hollow particles have been proposed. It is preferable in the present invention that hollow particles having an external layer made of a thermoplastic polymer and a volatile material as a core material are subjected to an evaporation-foaming treatment.

The hollow degree of the hollow particle for use in the present invention is represented as a percentage (%) of volume of voids in the hollow particles.

Since the hollow particles act as a heat insulating material while having an elasticity, the hollow particles efficiently use heat energy generated by a thermal head, resulting in improvement of coloring sensitivity. The hollow particles have a hollow degree of not less than 60%, and preferably from 80 to 95%. When the hollow degree is not greater than 60%, the above-mentioned effect is hardly obtained, and when the hollow degree is not less than 95%, strength thereof is inferior as the thickness of the film is thin.

The diameter of the hollow particles is preferably not greater than 10 μm such that the surface of a thermal recording material has good uniformity. When there is a particle having a diameter not less than 10 μm, a coating defect (a portion where a coating liquid is not formed) is generated in a thermal coloring layer formed thereon and thereby white spots tend to be formed.

Next, a feature of the present invention will be explained. The feature of the present invention is that a problem, in that when alcoholic flexographic ink is printed on the surface of a thermal recording material and a backside thereof, an alcohol solvent penetrates into a thermal coloring layer, thereby causing coloring of the coloring layer, can be avoided.

In particular, as a recent trend, the demand for the thermal recording material is shifting from POS labels for use in a food industry to labels for use in distribution and ticket industries. The thermal recording material is required to have good durability to a printing process and good qualities such as high speed printability (high heat sensitivity) rather than durability to a plasticizer contained in a polyvinyl chloride wrapping film.

In order to meet the above quality requirements, not only investigation of dyes and developers, and utilization of an intermediate layer, but also formation of a thin protective layer (about from 1 μm to 2 μm) are necessary. In particular, it is necessary for the thin protective layer to have excellent resistance to alcoholic flexographic ink ("flexo alcohol").

The present inventors did not particularly intend to search for a crosslinking agent improving resistance to alcoholic flexographic ink. The present inventors focused on a fact in that silanol group modified PVA and metallic salt have good resistance to water and relatively low toxicity compared to crosslinking agents such as glyoxal or epichlorohydrin crosslinking agents. The present inventors investigated to search for a crosslinking agent having stronger resistance to water. As a result of the investigation focusing on zirconium compounds, it is found that when zirconium lactate is used for silanol modified PVA not only strong resistance to water, but also good resistance to flexo alcohol, can be imparted to the resultant layer only.

Conventionally used zirconium salt was also investigated and as a result, a compound having good resistance to water such as carbonic acid zirconium ammonium was found. However a compound having good resistance to flexo alcohol was not found. The reason therefor is unknown.

The present inventors suppose that the reason is as follows.

Zirconium lactate has such a property as to be easy to dissolve in water and hardly dissolve in alcohol. Because of the water soluble property, zirconium lactate penetrates more deeply into a resin in a coating liquid and can be positioned closely to a functional group of the resin, resulting in formation of strong bonding with the functional group when it is dried. Because of the property such that zirconium lactate is hardly soluble in alcohol, the crosslinking structure is not changed and the resin is not swelled even when alcohol penetrates the resultant layer and thereby penetration of alcohol can be suppressed. In contrast, zirconium ammonium carbonate etc. dissolves in water and can have a strong crosslinking structure, but partially dissolves in alcohol. Therefore the crosslinking structure is damaged and then swelling and penetration occur when being contacted with alcohol.

In general, a zirconium compound forms a crosslinking structure with a —OH group of PVA. However, in reality, even when perfectly saponified PVA which has a largest number of —OH groups is used, the resistance to water is unsatisfactory. Therefore it seems that the silanol group forms a strong crosslinking structure together with zirconium salt.

In addition, among PVAs having a silanol group, PVAs having an ethylene unit therein have high resistance to water since a water molecule hardly penetrates PVAs. The addition amount of the crosslinking agent of the present invention, which depends on the modification degree of the resin and the kind of functional group of the resin, is preferably from 0.01 to 1 parts by weight and more preferably from 0.01 to 0.5 parts by weight per 1 part by weight of the resin. When the ratio of the crosslinking agent is less than 0.01, the resultant layer cannot obtain good resistance to water, and the resistance to alcoholic flexographic ink of the layer deteriorates. When the ratio is greater than 0.5, compounds which do not contribute towards formation of a crosslinking structure serve as foreign materials and deteriorate film formation property of the resin, resulting in deterioration of resistance to alcoholic flexographic ink.

In the present invention, by a reaction of a crosslinking agent penetrating from a protective layer and a specific PVA included in the thermal coloring layer, water resistance of a thermal coloring layer is improved and not only water resistance of a thermal recording material is improved, but also resistance to flexo alcohol is improved probably because a dye and a developer are covered by the resin which has strong resistance to alcohol.

In the present invention, by forming a back coat layer using a specific PVA and a specific crosslinking agent, background coloring can be prevented even when alcoholic flexographic ink is printed on the back surface of the substrate. In addition, if the intermediate layer of the present invention is provided, resistance to alcoholic flexographic ink penetrating from the back surface of the substrate can be improved and heat sensitivity of the thermal recording material can also be improved even when the backcoat layer is not provided. The thickness of the backcoat layer is not specially limited, but is preferably from about 0.5 μm to 5 μm and more preferably from 1 μm to 2.5 μm.

Conventionally used fillers can be included in the protective layer, backcoat layer and thermal coloring layer of the present invention. Specific examples of the fillers include inorganic pigments such as calcium carbonates, zinc oxide, aluminum oxide, titanium dioxide, silicas, aluminum hydroxide, barium sulfates, talcs, kaolins, aluminas, clays or well known organic pigments, but are not specially limited thereto.

In the present invention, well known crosslinking agents such as glyoxals, melamines, aziridine compounds, polyamide epichlorohydrin resins, carbonic acid zirconium ammoniums and ethylenediamines can be used in combination with the crosslinking agent of the present invention in such an amount as to enhance the function of the crosslinking agent.

One or more kinds of leuco dyes are used in the thermal coloring layer of the present invention. Any leuco dyes for use in thermal materials can be used. Specific examples of such leuco dyes include leuco compounds of dyes such as triphenylmethane, fluoran, phenothiazine, auramine, spiropyran and indolinone phthalide compounds. Specific examples of such leuco dyes include the following.

3,3-bis(p-dimethylaminophenyl)phthalide, 3,3-bis (p-dimethylaminophenyl)-6-dimethylaminophthalide (i.e., crystal violet lactone), 3,3-bis(p-dimethylaminophenyl)-6diethylaminophthalide, 3,3-bis(p-diethylaminophenyl)-6chlorophthalide, 3-cyclohexylamino-6-chlorofluoran, 3-dimethylamino-5, 7-dimethylfluoran, 3-diethylamino-7chlorofluoran, 3-diethylamino-7-methylfluoran, 3diethylamino-7, 8-benzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-{N-(3'-trifluoromethylphenyl)amino}-6-diethylamino-fluoran, 2-{3,6-bis(diethylamino)-9-(o-chloroanilino)xanthyl-}-benzoic acid lactam, 3-diethylamino-6-methyl-7-(m-trichloromethylanilino)-fluoran, 3-diethylamino-7-(o-chloroanilino) fluoran, 3-di-n-butylamino-7-(o-chloroanilino) fluoran, 3-N-methyl-N-n-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino)-fluoran, benzoyl leuco methylene blue, 6'-chloro-8'-methoxybenzoindolino-spiropyran, 6'-bromo-3'-methoxybenzoindolino-spiropyran, 3-(2'-hydroxy-4'-dimethylaminophenyl)-3-(2'-methoxy-5'-chlorophenyl) phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl) phthalide, 3-(2'-methoxy-4'-dimethylaminophenyl)-3-(2'-hydroxy-4'-chloro-5'-methylphenyl)phthalide, 3-N-ethyl-N-tetrahydrofurfurylamino-6-methyl-7-anilinofluoran, 3-N-ethyl-N-(2-ethoxypropyl)amino-6-methyl-7-anilinofluoran, 3N-methyl-N-isobutyl-6-methyl-7-anilinofluoran, 3-morphorino-7-(N-propyl-trifluoromethylanilino)-fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7(o-methoxycarbonylphenylamino)fluoran, 3-diethylamino-5-methyl-7α-phenylethylamino)fluoran, 3-diethylamino-7-piperidinofluoran, 2-chloro-3-(N-methyltoluidino)-7-(p-n-butylanilino) fluoran, 3-di-n-butylamino-6-methyl-7-anilinofluoran, 3,6-bis(dimethylamino)fluorenespiro(9,3')-6'-dimethylaminophthalide, 3-diethylamino-6-methyl-7-mesidino-4',5'-benzofluoran, 3-N-ethyl-N-isoamyl-6-methyl-7-anilinofluoran, 3-diethylamino-6-methyl-7-(2',4'-dimethylanilino) fluoran, 3-morphorino-7-(N-propyl-trifluoromethylanilino)-fluoran, 3-pyrrolidino-7trifluoromethylanilinofluoran, 3-diethylamino-5-chloro-7-(N-benzyl-trifluoromethylanilino) fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino -7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyltoluidino)-7-(p-n-butylanilino) fluoran, 3,6-bis(dimethylamino) fluorenespiro (9,3')-6'-dimethylaminophthalide, 3-(N-benzyl-N-cyclohexylamino)-5,6-benzo-7-α-naphthylamino-4'-bromofluoran, 3-N-ethyl-N-(2-ethoxypropyl)amino-6-methyl-7-anilinofluoran, 3-N-ethyl-N-tetrahydrofurfurylamino-6-methyl-7-anilinofluoran, 3-diethylamino-6-methyl-7-mesidino-4',5'-benzofluoran, 3-p-dimethylaminophenyl)-3-{1,1-bis(p-dimethylaminophenyl) ethylene-2-yl}phthalide, 3-(p-dimethylaminophenyl)-3-{1,1-bis(p-dimethylaminophenyl) ethylene-2-yl}-6-dimethylaminophthalide, 3-(p-dimethylaminophenyl)-3-(1-p-dimethylaminophenyl)-3-(1-p-dimethylaminophenyl-1-p-chlorophenylethylene-2-yl)-6-dimethylaminophtalide, 3-(4'-dimethylamino-2'-methoxy)-3-(1"-p-dimethylaminophenyl-1"-p-chlorophenyl-1",3"-butadiene-4"-yl)benzophthalide, 3-(4'-dimethylamino-2'-benzyloxy)-3-(1"-p-dimethylaminophenyl-1"-phenyl-1",3"-butadiene-4"-yl)benzophthalide, 3-dimethylamino-6-dimethylamino-fluoren-9-spiro-3'-(6'-dimethylamino) phthalide, 3,3-bis{2-(p-dimethylaminophenyl)-2-(p-methoxyphenyl) ethenyl}-4,5,6,7-tetrachlorophthalide, 3-bis[1,1-bis(4-pyrrolidinophenyl)ethylene-2-yl]-5,6-dichloro-4,7-dibromophthalide and bis(p-dimethylaminostyryl)-1-naphthalenesulfonylmethane.

In addition, various electron acceptors, oxidizing reagents, etc. which color the above-mentioned leuco dyes when being contacted therewith can be used as developers for use in the thermal coloring layer of the present invention. Such developers are well known and specific examples thereof include the following, but are not limited thereto.

4,4'-isopropylidenediphenol, 4,4'-isopropylidenebis (o-methylphenol), 4,4'-sec-butylidenebisphenol, 4,4'-isopropylidenebis (2-tert-butylphenol) , zinc p-nitrobenzoate, 1,3,5-tris(4-tert-butyl-3-hydroxy-2,6-dimethyl-benzyl) isocyanuric acid, 2,2-(3,4'-dihydroxyphenyl)propane, bis (4-hydroxy-3-methylphenyl) sulfide, 4-{β(p-methoxyphenoxy) ethoxy}salicylic acid, 1,7-bis(4-hydroxyphenylthio)-3,5-dioxaheptane, 1,5-bis(4-hydroxyphenylthio)-5-oxapentane, monocalcium salt of monobenzyl phthalate, 4,4'-cyclohexylidenediphenol, 4,4'-isopropylidenebis(2-chlorophenol), 2,2'-methylenebis(4-methyl-6-tert-butylphenol), 4,4'-butylidenebis(6-tert-butyl-2-methyl) phenol, 1,1,3-tris(2-methyl-4-hydroxy-5-tert-butylphenyl) butane, 1,1,3-tris(2-methyl-4-hydroxy-5-cyclohexylphenyl)-butane, 4,4'-thiobis(6-tert-butyl-2-methylphenol), 4,4'-diphenolsulfone, 4-isopropoxy-4'-hydroxydiphenylsulfone, 4-benzyloxy-4'-hydroxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,3-bis(4-hydroxyphenylthio) propane, N,N'-diphenylthiourea, N, N'-di(m-chlorophenyl) thiourea, salicylanilide, bis (4-hydroxyphenyl)methyl acetate, bis(4-hydroxyphenyl) benzyl acetate, 1,3-bis(4-hydroxycumyl) benzene, 1,4-bis (4-hydroxycumyl)benzene, 2,4'-diphenolsulfone, 2,2'-diallyl-4,4'-diphenolsulfone,3,4-dihydroxyphenyl-4'-methyldiphenylsulfone, zinc 1-acetyloxy-2-naphthoate, zinc 2-acetyloxy-1-naphthoate, zinc 2-acetyloxy-3-naphthoate, α, α-bis(4-hydroxyphenyl)-α-methyltoluene, antipyrine complex of zinc thiocyanate, tetrabromobisphenol A, tetrabromobisphenol S, 4,4'-thiobis(2-methyiphenol), and 4,4'-thiobis(2-chlorophenol).

In the thermal recording material of the present invention, the developer is used in an amount of from 1 to 20 parts, and preferably from 2 to 10 parts, per 1 part of the coloring agent. The developers can be used alone or in combination. The coloring agents can also be used alone or in combination. When a combination of the leuco dyes and the developers is bonded with a substrate when preparing the thermal recording material of the present invention, polyvinyl alcohol containing a reactive carbonyl group is preferably used and common various binders can be optionally used with or without being combined with the polyvinyl alcohol. Specific examples of the binders include the following.

Polyvinyl alcohol, starch and derivatives thereof, cellulose derivatives such as hydroxymethyl cellulose, hydroxy ethyl cellulose, carboxymethyl cellulose, methyl cellulose, ethyl cellulose, water-soluble polymers such as polyacrylic acid sodium salt, polyvinylpyrrolidone, acrylamide/acrylate copolymers, acrylamide/acrylate/methacrylic acid copolymers, alkali metal salts of styrene/maleic anhydride copolymers, alkali metal salts of isobutylene-maleic anhydride copolymers, polyacrylamide, sodium alginate, gelatin, casein, emulsions of resins such as polyvinyl acetate, polyurethane, polyacrylic acid, polyacrylate, vinyl chloride/vinyl acetate copolymers, polybutyl methacrylate, ethylene/vinyl acetate copolymers and latex etc such as styrene/butadiene copolymers, styrene/ butadiene/acryl copolymers and the like.

In addition, in the present invention, various thermofusible materials can be used as a heat sensitivity improver. Specific examples of the heat sensitivity improvers include the following, but are not limited thereto.

Fatty acids such as stearic acid and behenic acid, fatty acid amides such as stearic acid amide and palmitic acid amide, fatty acid metal salts such as zinc stearate, aluminum stearate, calcium stearate, zinc palmitate and zinc behenate, p-benzylbiphenyl, terphenyl, triphenyl methane, benzyl p-benzyloxybenzoate, β-benzyloxynaphthalene, phenyl β-naphthoate, phenyl 1-hydroxy-2-naphthoate, methyl 1-hydroxy-2-naphthoate, diphenyl carbonate, guaiacol carbonate, dibenzyl terephthalate, dimethyl terephthalate, 1,4-dimethoxynaphthalene, 1,4-diethoxynaphthalene, 1,4-dibenzyloxynaphthalene, 1,2-diphenoxyethane, 1,2-bis(3-methylphenoxy)ethane, 1,2-bis(4-methylphenoxy)ethane, 1,4-diphenoxy-2-butene, 1,2-bis(4-methoxyphenylthio) ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy) benzene, p-(2-vinyloxyethoxy) biphenyl, p-aryloxybiphenyl, p-propagyloxybiphenyl, dibenzoyloxymethane, dibenzoyloxypropane, dibenzyldisulfide, 1,1-diphenylethanol, 1,1-diphenylpropanol, p-benzyloxybenzylalcohol, 1,3-phenoxy-2-propanol, N-octadecylcarbamoyl-p-methoxycarbonylbenzene, N-octadecylcarbamoylbenzene, 1,2-bis(4-methoxyphenoxy) propane, 1,5-bis(4-methoxyphenoxy)-3-oxapentane, dibenzyl oxalate, bis(4-methylbenzyl)oxalate and bis(4-chlorobenzyl) oxalate.

The thermal coloring layer is prepared by coating a coating liquid, which is prepared by dispersing or dissolving uniformly a coloring agent, a developer and a binder in water on a substrate and then drying the coated liquid, but the coating method is not specially limited. A diameter of particles dispersed in the coloring layer coating liquid is preferably not greater than 5 μm and more preferably not greater than 1 μm. The thickness of the coloring layer is determined depending upon the composition thereof and applications of the thermal recording material, but the thickness is from 1 to 50 μm, and more preferably from 3 to 20 μm. In addition, the coloring coating liquid can optionally include various additives used in normal thermal recording materials for the purpose of improving the coating property and recording property. In addition, a protective layer can be located overlying the back surface of the substrate of the thermal recording material of the present invention. Similarly to the binder resin used in the protective layer located overlying the above-mentioned thermal coloring layer, polyvinyl alcohol containing a reactive carbonyl group is preferably used as a binder resin of the protective layer. Furthermore, a pigment, a lubricant, a crosslinking agent, etc. can also be included in the protective layer formed on the back surface to improve anti-blocking property and drying property when coated.

Both an acid paper and a neutral paper can be used as a substrate of the present invention. In addition, the calcium content of the above-mentioned neutral paper substrate and a released paper made of neutral paper is preferably as small as possible. Such neutral paper and released paper containing a small amount of calcium can be prepared by reducing the ratio of recycled paper used in paper production. Normally, calcium carbonate is used as an internal additive and alkyl ketene dimers or anhydrous alkenyl succinic acid are used as a sizing agent in neutral paper production. However, it is preferable that the internal additive is replaced with talc and clay, while using a neutral rosin sizing agent to prepare the neutral paper for use in the present invention.

Regarding the layer structure of the thermal recording material of the present invention, a thermal coloring layer is located overlying a substrate and a protective layer is located overlying the thermal coloring layer, and another protective layer is located overlying the back surface of the substrate. Each layer does not need to be contacted with each other and an intermediate layer can be provided between the substrate and the thermal coloring layer, between the thermal coloring layer and the protective layer, and between the substrate and the protective layer on the back surface of the substrate. In particular, a heat insulating layer is preferably formed between the substrate and the thermal coloring layer. The heat insulating layer preferably uses a hollow resin particle having a hollow degree not less than 80%. Furthermore, each of the above-mentioned layers can be a single layer or a multiple layer.

Recording methods of the thermal recording material of the present invention can be methods using a heat pen, a thermal head, laser heating or the like, which are determined depending on the application of the recording material, but the recording method is not specially limited thereto.

EXAMPLES

Example 1

(1) Preparation of Dye Dispersion (Liquid A)

The following components were mixed and dispersed with a sand mill until the components have an average particle diameter of 0.5 μm.

| | |
|---|---|
| 3-dibutylamino-6-methyl-7-anilinofluoran | 20 parts |
| 10% aqueous solution of polyvinyl alcohol | 20 parts |
| Water | 60 parts |

(2) Preparation of Liquid B

The following components were mixed and dispersed with a sand mill until the components have an average particle diameter of 0.5 μm.

| | |
|---|---|
| 4-isopropoxy-4'-hydroxydiphenylsulfone | 20 parts |
| di-(p-methylbenzyl)oxalate | 10 parts |
| calcium carbonate | 10 parts |
| 10% aqueous solution of polyvinyl alcohol | 30 parts |
| Water | 30 parts |

(3) Preparation of Thermal Coloring Layer Coating Liquid

The following components were mixed to prepare a thermal coloring layer coating liquid.

| | |
|---|---|
| Liquid A | 20 parts |
| Liquid B | 60 parts |
| Carboxyl group modified PVA (solid content: 10%, KL318 manufactured by Kuraray Co., Ltd.) | 30 parts |
| aqueous solution of dioctyl sulfo succinic acid (solid content: 5%) | 1 part |

(4) Preparation of Protective Layer Coating Liquid

The following components were mixed to prepare a protective layer coating liquid.

| | |
|---|---|
| aluminum hydroxide dispersion (solid content: 50%) | 40 Parts |
| zinc stearate dispersion (solid content: 30%) | 6 parts |
| aqueous solution of dioctyl sulfo succinic acid (solid content: 5%) | 1 part |
| 10% solution of polyvinyl alcohol containing a silanol group (R1130 manufactured by Kuraray Co., Ltd.) | 200 parts |
| 10% aqueous solution of zirconium annomium lactate (Z-1185 manufactured by Matsumoto Chemical Industry Co., Ltd.) (crosslinking agent) | 20 parts |
| water | 43 parts |

(5) Preparation of Thermal Recording Material

The thermal coloring layer coating liquid was coated on a substrate (a wood free paper having a basis weight of about 60 g/m$^2$) and dried to form a thermal coloring layer having a deposition amount of about 0.6 g/m$^2$on a dry basis. Furthermore, the protective layer coating liquid was coated on the thermal coloring layer and dried to form a protective layer having a deposition amount of about 1.6 g/m$^2$ on a dry basis. Then the surface of the substrate was subjected to a calendering treatment to smooth the surface thereof, and the substrate was subjected to a curing treatment at 40° C. for 24 hours to prepare a thermal recording material.

Example 2

The procedure for preparation of the thermal recording material in Example 1 was repeated except that the 10% solution of polyvinyl alcohol containing a silanol group (R1130 manufactured by Kuraray Co., Ltd.) was replaced with an ethylene modified PVA modified with a silanol group (RS43 manufactured by Kuraray Co., Ltd.) to prepare a thermal recording material.

Example 3

The procedure for preparation of the thermal recording material in Example 1 was repeated except that the addition quantity of the 10% aqueous solution of zirconium ammonium lactate (Z-1185 manufactured by Matsumoto Chemical Industry Co. Ltd.) (crosslinking agent) was changed from 20 parts to 120 parts to prepare a thermal recording material.

Example 4

The procedure for preparation of the thermal recording material in Example 1 was repeated except that the addition quantity of the 10% aqueous solution of zirconium ammonium lactate (Z-1185 manufactured by Matsumoto Chemical Industry Co. Ltd.) (crosslinking agent) was changed from 20 parts to 100 parts to prepare a thermal recording material.

Example 5

The procedure for preparation of the thermal recording material in Example 1 was repeated except that the addition quantity of the 10% aqueous solution of zirconium ammonium lactate (Z-1185 manufactured by Matsumoto Chemical Industry Co. Ltd.) (crosslinking agent) was changed from 20 parts to 2 parts to prepare a thermal recording material.

Example 6

The procedure for preparation of the thermal recording material in Example 1 was repeated except that the addition quantity of the 10% aqueous solution of zirconium ammonium lactate (Z-1185 manufactured by Matsumoto Chemical Industry Co., Ltd.) (crosslinking agent) was changed from 20 parts to 1 part to prepare a thermal recording material.

Example 7

The procedure for preparation of the thermal recording material in Example 1 was repeated except that the carboxyl modified PVA (solid content: 10%) used in the thermal coloring layer was replaced with 10% solution of polyvinyl alcohol containing a silanol group (R1130 manufactured by Kuraray Co., Ltd.) to prepare a thermal recording material.

Example 8

The procedure for preparation of the thermal recording material in Example 1 was repeated except that the carboxyl modified PVA (solid content: 10%) used in the thermal coloring layer was replaced with an ethylene modified PVA modified with a silanol group (RS43 manufactured by Kuraray Co., Ltd.) to prepare a thermal recording material.

Example 9

Preparation of Backcoat Layer Coating Liquid

The following components were mixed to prepare a backcoat layer coating liquid.

| | |
|---|---|
| aluminum hydroxide dispersion (solid content: 50%) | 40 parts |
| 5% aqueous solution of dioctylsulfosuccinic acid | 1 part |
| 10% solution of polyvinyl alcohol containing a silanol group (R1130 manufactured by Kuraray Co., Ltd.) | 200 parts |
| 10% aqueous solution of zirconium ammonium lactate (Z-1185 manufactured by Matsumoto Chemical Industry Co., Ltd.) (crosslinking agent) | 20 parts |
| Water | 43 parts |

Preparation of Thermal Recording Material

Similarly to Example 1, after a thermal coloring layer and a protective layer are provided, the surface of the substrate was subjected to a calendering treatment to be smoothed, and then the substrate was subjected to a cure treatment at 40° C. for 24 hours to prepare a thermal recording material. A backcoat layer was provided by applying the backcoat layer coating liquid to the substrate surface opposite that on which the thermal coloring layer coating liquid is applied.

Example 10

The procedure for preparation of the thermal recording material in Example 9 was repeated except that the 10% solution of polyvinyl alcohol containing a silanol group (R1130 manufactured by Kuraray Co., Ltd.) used for preparing the backcoat layer coating liquid in Example 9 was replaced with an ethylene modified PVA modified with a silanol group (RS43 manufactured by Kuraray Co., Ltd.) to prepare a thermal recording material.

Example 11

Preparation of Intermediate Layer (Heat Insulating Layer)

The following mixtures were agitated and dispersed to prepare an intermediate layer (heat insulating layer) forming liquid.

| | |
|---|---|
| acrylonitrile/methacrylonitrile/isobonrylacrylate copolymer having a hollow degree of 90%, a center particle diameter of 3 μm, a maximum particle diameter of 9 μm and a solid content of 30% | 30.0 parts |
| styrene/butadiene copolymer latex (solid content: 47%) | 15.0 parts |
| water | 55 parts |

Preparation of Thermal Recording Material

The intermediate layer (heat insulating layer) forming liquid was coated on a substrate and dried to form an intermediate layer (heat insulating layer) having a deposition amount of 2.5 g/m$^2$ on a dry basis. In addition, similarly to Example 1, after a thermal coloring layer and a protective layer are provided, the surface of the substrate was subjected to a calendering treatment to be smoothed, and then the substrate was subjected to a cure treatment at 40° C. for 24 hours to prepare a thermal recording material.

Comparative Example 1

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing the protective layer coating liquid in Example 1 was replaced with 20 parts of 10% solution of zirconium oxychloride salt (ZIRCOSOL ZC-2 manufactured by Daiichi Kigenso Kagaku Kogyo Co., Ltd.) to prepare a thermal recording material.

Comparative Example 2

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of 10% solution of zirconium sulphate salt (ZIRCOSOL ZS manufactured by Daiichi Kigenso Kagaku Kogyo Co., Ltd.) to prepare a thermal recording material.

Comparative Example 3

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of 10% solution of zirconium nitrate salt (ZIRCOSOL ZN manufactured by Daiichi Kigenso Kagaku Kogyo Co., Ltd.) to prepare a thermal recording material.

Comparative Example 4

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of 10% solution of acetic acid zirconium salt (ZA manufactured by Daiichi Kigenso Kagaku Kogyo Co., Ltd.) to prepare a thermal recording material.

Comparative Example 5

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) aqueous solution used for preparing a protective layer coating liquid in Example 1 was replaced with 20 parts of 10% solution of carbonic acid zirconium salt (carbonic acid zirconyl manufactured by Daiichi Kigenso Kagaku Kogyo Co., Ltd.) to prepare a thermal recording material.

Comparative Example 6

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of 10% solution of carbonic acid zirconium ammonium salt (AC-7 manufactured by Daiichi Kigenso Kagaku Kogyo Co., Ltd.) to prepare a thermal recording material.

Comparative Example 7

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of 10% solution of stearic acid zirconium salt (manufactured by Daiichi Kigenso Kagaku Kogyo Co., Ltd.) to prepare a thermal recording material.

Comparative Example 8

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of a 10% dispersion of octyl acid zirconium salt (manufactured by Daiichi Kigenso Kagaku Kogyo Co., Ltd.) to prepare a thermal recording material.

Comparative Example 9

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of a 10% dispersion of silicic acid zirconium salt (manufactured by Daiichi Kigenso Kagaku Kogyo Co., Ltd.) to prepare a thermal recording material.

Comparative Example 10

The procedure for preparation of the thermal recording material in Example 1 was repeated except that 20 parts of the 10% aqueous solution of zirconium ammonium lactate (Z-1185 manufactured by Matsumoto Chemical Industry Co., Ltd.) (crosslinking agent) used for preparing a protective layer coating liquid in Example 1 was replaced with 20 parts of a 10% dispersion of titanium lactate (TC-310 manufactured by Matsumoto Chemical Industry Co., Ltd.) to prepare a thermal recording material.

Comparative Example 11

The procedure for preparation of the thermal recording material in Example 1 was repeated except that the 10% solution of polyvinyl alcohol containing a silanol group (R1130 manufactured by Kuraray Co., Ltd.) used for preparing a protective layer coating liquid in Example 1 was replaced with a perfectly saponified PVA (PVA117 manufactured by Kuraray Co., Ltd.) to prepare a thermal recording material.

Comparative Example 12

The procedure for preparation of the thermal recording material in Example 1 was repeated except that the 10% solution of polyvinyl alcohol containing a silanol group (R1130 manufactured by Kuraray Co., Ltd.) used for preparing a protective layer coating liquid in Example 1 was replaced with a carboxyl modified PVA (KL318 manufactured by Kuraray Co., Ltd.) to prepare a thermal recording material.

Constitutions of Examples and Comparative Examples are shown in Table 1-1 and Table 1-2.

The results are shown in Table 2.

<Evaluation Method>

(Resistance to Water)

Samples of a thermal recording material were dipped in water at room temperature for 16 hours and then the surface or the back surface (only the samples with the backcoat layer were evaluated as to the back surface) of the recording material was rubbed 10 times to observe the condition of the surfaces.

: the protective layer was not peeled at all.

○: the protective layer was not peeled but the surface thereof was slimy. (no problem for a practical use)

Δ: the protective layer was slightly peeled.

×: the protective layer or the backcoat layer was melted.

(Resistance to Temperature and Humidity)

Samples of thermal recording materials were kept under an environmental condition of 40° C. 90% relative humidity for 24 hours. Then the image densities of non-image portions were measured using a blue filter (a filter for measuring yellow density) of a reflection density measuring apparatus manufactured by Macbeth Co.

(Resistance to Alcoholic Flexographic Ink Test)

FLEXO ALCOHOL INK 75100 manufactured by SICPA was coated on the surface or the back surface of the samples of thermal recording materials at 0.1 WB and dried by a dryer. Then the background coloring density of the samples was measured by the reflection density measuring apparatus manufactured by Macbeth Co.

The ink was coated on either the surface or the back surface of a sample in order to confirm the effect of each surface.

TABLE 1-1

| | Protective layer | | | Thermal coloring | | Backcoat layer | |
|---|---|---|---|---|---|---|---|
| | Resin | Cross-linking agent | Deposit amount | layer Resin | Intermediate layer | Resin | Cross-linking agent |
| Example 1 | Silanol modified PVA | Zirconium ammonium lactate | 0.1 | PVA containing carboxyl group | No | No | No |
| Example 2 | Silanol modified ethylene-modified PVA | Zirconium ammonium lactate | 0.1 | PVA containing carboxyl group | No | No | No |
| Example 3 | Silanol modified PVA | Zirconium ammonium lactate | 0.60 | PVA containing carboxyl group | No | No | No |
| Example 4 | Silanol modified PVA | Zirconium ammonium lactate | 0.50 | PVA containing carboxyl group | No | No | No |
| Example 5 | Silanol modified PVA | Zirconium ammonium lactate | 0.01 | PVA containing carboxyl group | No | No | No |
| Example 6 | Silanol modified PVA | Zirconium ammonium lactate | 0.005 | PVA containing carboxyl group | No | No | No |

TABLE 1-1-continued

| | Protective layer | | | Thermal coloring layer | | Backcoat layer | |
|---|---|---|---|---|---|---|---|
| | Resin | Cross-linking agent | Deposit amount | Resin | Intermediate layer | Resin | Cross-linking agent |
| Example 7 | Silanol modified PVA | Zirconium ammonium lactate | 0.1 | Silanol modified PVA | No | No | No |
| Example 8 | Silanol modified PVA | Zirconium ammonium lactate | 0.1 | Silanol modified ethylene-modified PVA | No | No | No |
| Example 9 | Silanol modified PVA | Zirconium ammonium lactate | 0.1 | PVA containing carboxyl group | No | Silanol modified PVA | Zirconium ammonium lactate |
| Example 10 | Silanol modified PVA | Zirconium ammonium lactate | 0.1 | PVA containing carboxyl group | No | Silanol modified ethylene-modified PVA | Zirconium ammonium lactate |
| Example 11 | Silanol modified PVA | Zirconium ammonium lactate | 0.1 | PVA containing carboxyl group | Undercoat layer containing specific monomer hollow particle | No | No |

TABLE 1-2

| | Protective layer | | | Thermal coloring layer | | Backcoat layer | |
|---|---|---|---|---|---|---|---|
| | Resin | Cross-linking agent | Deposit amount | Resin | Intermediate layer | Resin | Cross-linking agent |
| Comparative Example 1 | Silanol modified PVA | zirconium oxychloride | 0.1 | PVA containing carboxyl group | No | No | No |
| Comparative Example 2 | Silanol modified PVA | zirconium sulphate | 0.1 | PVA containing carboxyl group | No | No | No |
| Comparative Example 3 | Silanol modified PVA | zirconium nitrate | 0.1 | PVA containing carboxyl group | No | No | No |
| Comparative Example 4 | Silanol modified PVA | acetic acid zirconium | 0.1 | PVA containing carboxyl group | No | No | No |
| Comparative Example 5 | Silanol modified PVA | carbonic acid zirconium | 0.1 | PVA containing carboxyl group | No | No | No |
| Comparative Example 6 | Silanol modified PVA | carbonic acid zirconium | 0.1 | PVA containing carboxyl group | No | No | No |
| Comparative Example 7 | Silanol modified PVA | stearic acid zirconium | 0.1 | PVA containing carboxyl group | No | No | No |
| Comparative Example 8 | Silanol modified PVA | octyl acid zirconium | 0.1 | PVA containing carboxyl group | No | No | No |

TABLE 1-2-continued

| | Protective layer | | | Thermal coloring layer | Intermediate layer | Backcoat layer | |
|---|---|---|---|---|---|---|---|
| | Resin | Cross-linking agent | Deposit amount | Resin | | Resin | Cross-linking agent |
| Comparative Example 9 | Silanol modified PVA | silicic acid zirconium | 0.1 | PVA containing carboxyl group | No | No | No |
| Comparative Example 10 | Silanol modified PVA | titanium lactate | 0.1 | PVA containing carboxyl group | No | No | No |
| Comparative Example 11 | Perfect saponification PVA | Zirconium ammonium lactate | 0.1 | PVA containing carboxyl group | No | No | No |
| Comparative Example 12 | Carboxyl modified PVA | Zirconium ammonium lactate | 0.1 | PVA containing carboxyl group | No | No | No |

TABLE 2

| | Protective layer | | | | Backcoat layer | |
|---|---|---|---|---|---|---|
| | Resistance to flexo ink | Resistance to water | Resistance to temperature and humidity | Resistance to flexo ink | Resistance to water | Sensitivity |
| Example 1 | 0.10 | ○ | 0.05 | 0.16 | — | 1.00 |
| Example 2 | 0.10 | ◎ | 0.05 | 0.16 | — | 1.00 |
| Example 3 | 0.16 | ○ | 0.05 | 0.16 | — | 1.00 |
| Example 4 | 0.12 | ○ | 0.05 | 0.16 | — | 1.00 |
| Example 5 | 0.12 | ○ | 0.05 | 0.16 | — | 1.00 |
| Example 6 | 0.18 | ○ | 0.05 | 0.17 | — | 1.00 |
| Example 7 | 0.08 | ◎ | 0.05 | 0.16 | — | 1.00 |
| Example 8 | 0.08 | ◎ | 0.05 | 0.16 | — | 1.00 |
| Example 9 | 0.10 | ○ | 0.05 | 0.10 | ○ | 1.00 |
| Example 10 | 0.10 | ○ | 0.05 | 0.07 | ◎ | 1.00 |
| Example 11 | 0.10 | ○ | 0.05 | 0.07 | — | 1.10 |
| Comparative Example 1 | 0.23 | X | 0.05 | 0.16 | — | 1.00 |
| Comparative Example 2 | 0.24 | X | 0.05 | 0.16 | — | 1.00 |
| Comparative Example 3 | 0.24 | Δ | 0.05 | 0.16 | — | 1.00 |
| Comparative Example 4 | 0.23 | X | 0.05 | 0.16 | — | 1.00 |
| Comparative Example 5 | 0.24 | ○ | 0.05 | 0.17 | — | 1.00 |
| Comparative Example 6 | 0.23 | X | 0.05 | 0.16 | — | 1.00 |
| Comparative Example 7 | 0.23 | X | 0.05 | 0.16 | — | 1.00 |
| Comparative Example 8 | 0.24 | X | 0.05 | 0.17 | — | 1.00 |
| Comparative Example 9 | 0.24 | ○ | 0.16 | 0.16 | — | 1.00 |
| Comparative Example 10 | 0.24 | X | 0.05 | 0.17 | — | 1.00 |
| Comparative Example 11 | 0.23 | X | 0.05 | 0.16 | — | 1.00 |
| Comparative Example 12 | 0.23 | X | 0.05 | 0.17 | — | 1.00 |

—: not evaluated

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2002-268751 filed on Sep. 13, 2002, the entire contents of which are herein incorporated by reference.

What is claimed is:

1. A thermal recording material comprising a substrate;

a thermal coloring layer which is located overlying the substrate and which comprises a leuco dye and a developer for coloring the leuco dye upon application of heat; and a protective layer which is located overlying the thermal coloring layer and which comprises a binder resin, a crosslinking agent and a filler, wherein the binder resin in the protective layer comprises a polyvinyl alcohol having a silanol group, and the crosslinking agent comprises a zirconium compound of lactic acid.

2. The thermal recording material according to claim 1, wherein the polyvinyl alcohol is an ethylene-modified polyvinyl alcohol having an ethylene unit and a silanol group.

3. The thermal recording material according to claim 1, wherein the crosslinking agent is included in an amount of from 0.01 to 0.50 parts by weight per 1 part by weight of the binder resin.

4. The thermal recording material according to claim 1, wherein the thermal coloring layer further comprises a polyvinyl alcohol having a silanol group.

5. The thermal recording material according to claim 4, wherein the polyvinyl alcohol in the thermal coloring layer is an ethylene-modified polyvinyl alcohol having an ethylene unit and a silanol group.

6. The thermal recording material according to claim 1, wherein the substrate has opposite sides, the thermal coloring layer overlying one of the sides, and further comprising a backcoat layer which is located overlying the other of said sides of the substrate, the backcoat layer comprising a polyvinyl alcohol having a silanol group and a zirconium compound of lactic acid serving as a crosslinking agent.

7. The thermal recording material according to claim 1, further comprising an intermediate layer which is located between the substrate and the thermal coloring layer and which comprises a hollow particle of a copolymer comprising monomer units of acrylonitrile, methacrylonitrile and a monomer having the following formula (I):

(I)

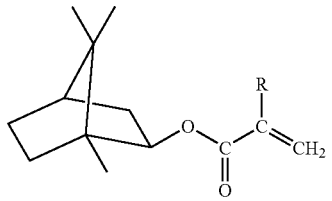

wherein R represents a hydrogen atom or a methyl group.

8. The thermal recording material according to claim 1, wherein the substrate has opposite sides, the thermal coloring layer overlying one of the sides, and further comprising an adhesive agent layer located overlying the other of said sides of the substrate.

9. The thermal recording material according to claim 6, wherein an adhesive agent layer is located overlying a surface of the backcoat layer.

10. The thermal recording material according to claim 1, further comprising an ink layer which is located overlying a surface of the protective layer and uses an ink including alcohol.

* * * * *